United States Patent [19]

Blackerby

[11] Patent Number: 4,709,561

[45] Date of Patent: Dec. 1, 1987

[54] APPARATUS AND METHOD FOR IMPROVING DRIVE FOR A CIRCULAR KNITTING MACHINE TO REDUCE WEAR AND GEAR BREAKAGE

[76] Inventor: William I. Blackerby, P.O. Box 4111, Anderson, S.C. 29622

[21] Appl. No.: 911,170

[22] Filed: Sep. 24, 1986

[51] Int. Cl.[4] ..... D04B 15/94

[52] U.S. Cl. ..... 66/8; 192/70.13; 192/110 S; 403/16

[58] Field of Search ..... 66/8, 56; 192/45, 70.13, 192/110 S; 403/16

[56] References Cited

U.S. PATENT DOCUMENTS

| | | | |
|---|---|---|---|
| 1,291,883 | 1/1919 | Highland | 192/70.13 |
| 3,563,352 | 2/1971 | Stibbe | 192/45 X |
| 3,623,581 | 11/1971 | Livezey | 192/45 |
| 3,854,561 | 12/1974 | Conde | 192/45 X |
| 4,063,747 | 12/1977 | Young | 192/45 X |

FOREIGN PATENT DOCUMENTS

| | | | |
|---|---|---|---|
| 1013827 | 8/1957 | Fed. Rep. of Germany | 66/8 |

*Primary Examiner*—Wm. carter Reynolds
*Attorney, Agent, or Firm*—Cort Flint

[57] ABSTRACT

A drive for a circular knitting machine (10) used in the manufacture of panty hose blanks, using a one-way clutch (A) in the drive connection which permits a main drive shaft (16) to be rotated in one direction but does not permit it to be rotated in the opposite direction. The knitting machine may also be driven while the main power source is at rest, that is, the knitting machine may over-run or coast to a stop after the power source has been disconnected and the needle cylinder may be revolved manually during set up. The one-way clutch (A) comprises a clutch body (30) which is connected to the main drive shaft (16) and fits within an outer race (28) of an input drive sheave (20) which is driven by a suitable power source. The clutch body has three or more L-shaped recesses (36) evenly spaced about its periphery and each of said recesses had disposed therein a rounded member such as a roll (40) which is spring (42) urged towards the periphery of the clutch body and into wedging contact with the clutch body and the outer race. The use of the one-way clutch of the invention in knitting machines automatically compensates for wear and prevents slippage due to excessive wear and grab starts. This prevents excessive breakage of the spiral, beveled gears and excessive down time for the knitting machine.

16 Claims, 3 Drawing Figures

PRIOR ART

APPARATUS AND METHOD FOR IMPROVING DRIVE FOR A CIRCULAR KNITTING MACHINE TO REDUCE WEAR AND GEAR BREAKAGEcl

BACKGROUND OF THE INVENTION

The present invention relates to an improved clutch drive for circular knitting machines and is particularly useful in those circular knitting machines used for knitting panty hose blanks and reducing gear breakage and repair down time.

In particular, the invention is directed to converting the drive of a "Billi Ultra 4-S" knitting machine to improve the wear of the clutch components and thus reduce slippage and resulting gear teeth breakage.

It has been common practice in the knitting industry to employ variable speed motors having controls to vary the speed of the knitting machine in accordance with different kinds and weights of yarn, and with different modes of operation, as required, during the knitting of different parts of the panty hose blank. Such machines comprise needle cylinders which have either three hundred and forty or four hundred and two needles disposed within slots on the cylinder. Examples of such machines are those made and sold by Aroldo Billi and Company of Rezato, Italy, under the trademarks Zodiac Ultra 4, Ultra 4C, or Ultra 4S. In all such machines, it is necessary to permit the needle cylinder and the machine to freewheel, momentarily after the knitting machine is disconnected from the drive source. To permit the required freewheeling, such knitting machines include a oneway clutch between the drive shaft of the knitting machine and the drive source, e.g. sheaves driven by a suitable motor or other drive. Such machines have commonly used the so called sprag-type clutch having S-formed sprags to connect the sheave to the drive shaft when the sheave is driven in one direction so that the drive shaft is rotated in said direction by the sheave. On the other hand, the sprag- clutch permits the drive shaft to continue rotating after the sheave has stopped and prevents the knitting machine from being driven in the reverse direction. An example of the sprag-type clutch is illustrated in the FIG. 4 labeled "Prior Art."

The sprag-type clutch transfers torque in only one direction, and releases (over-runs) when input rotation is reversed or when the output overspeeds the input. The typical sprag-type clutch has a cylindrical inner race, a cylindrical outer race, S-formed sprags in the radial space between the races, and a greater spring to retain the sprages.

The sprags are shaped, sized (the height of each sprag is greater than the radial space between the races), and mounted so that they wedge between the two races to transmit torque from one race to the other when rotation occurs in one direction. When rotation occurs in the opposite direction, the sprags are freed, enabling them to slide on the races, causing the clutch to overrun.

To provide and maintain instantaneous drive engagement, all of the sprags must engage both the inner and the outer races at the same time. One method employs a garter spring at both axial ends of the sprags, located in notches in the sprags. The force of the garter spring tends to pivot the sprags around the axis and hold them in contact with both of the races.

Because a drag contact exists between the sprag and the races to transmit torque, wear becomes very important in the performance of the clutch. If maximum clutch life is to be sustained, the design sprag geometry must be preserved.

It has been found, according to the invention, that the recurring problem of gear teeth breakage commonly found on the aforementioned type of circular hose knitting machinery is due mainly to the wearing of the S-formed sprags in the clutch for the main drive.

As the sprags begin to wear, a condition in the clutch called "roll-over" occurs. This condition occurs when the sprags pivot beyond the point of recovery. Long before the sprag clutch reaches the roll-over condition, its efficiency in transmitting the torque from the sheave to the drive shaft through contacts between the inner and outer races deteriorates. When this happens, instead of the torque of the motor being instantly connected to the drive shaft as the motor torque begins to build up, there will be slippage and then a grabbing or jerking of the drive shaft after the drive motor has attained its full speed. When this happens, the drive shaft may become twisted resulting in the drive train gears being driven out of time. Eventually, the teeth of the helical beveled drive gears or other of the drive train gears may become broken. Apart from the fact that the helical beveled gears used to drive the needle cylinder are quite expensive, an even greater economic loss is suffered from the fact that it requires more than four hours to replace the helical beveled gears, which results in a great loss of production of panty hose. In a typical machine, this means a loss of about five thousand (5,000) pairs of panty hose for each time a gear is broken. It has been found that in machines utilizing the sprag clutch that the wear of such clutch can result in a breakage as often as every two weeks. Thus, it can be seen that the use of the conventional spragtype clutch in this knitting machine can cause considerable problems and result in an enormous economic loss.

While other forms of sprag clutches have been used, for example, a roll formed sprag, application of such clutches have not been made to circular knitting machine devices, vices, and are not suitable for transmitting torque between the inner and outer races of the drive of the aforementioned knitting machines.

Typical circular hose knitting machines are illustrated in U.S. Pat. Nos. 3,021,699 and 4,267,708 the latter being directed to a program drum for controlling a "Billi" circular hose knitting machine described previously.

Accordingly, an object of the invention is to provide an improved drive arrangement for a circular knitting machine which utilizes a one-way clutch which is not susceptible to the wear problem noted above with regard to the sprag clutch used in conventional knitting machines.

Another object of the invention is to provide a method for reducing the problems of excessive wear and slippage in a circular knitting machine.

Yet another object of the invention is to provide a method in improved drive for a circular knitting machine which eliminates the need for, and the replacement of, the inner bearing race commonly used in sprag-type clutches.

SUMMARY OF THE INVENTION

The above objectives are accomplished in accordance with the present invention by providing an improved one-way clutch drive for a circular knitting machine.

The conventional sprag-type as described above and as shown in the Prior Art Figure, is replaced with a drive which comprises a driven, hollow sheave which is rotatably supported on the drive shaft by outer and inner bearings. Disposed between the inner and outer bearings is a clutch body which is keyed to the drive shaft. The clutch body has a plurality of evenly spaced recesses in its outer periphery and the diameter of the clutch body is only slightly less than the inner diameter or the outer race of the sheave. A cylindrical, roll-shaped member is disposed within each of the recesses within the outer periphery of the clutch body and are urged up an inclined surface of the recess into engaging contact between said surface and the outer race of the sheave by spring means.

When the sheave is rotated in one direction, the cylindrical body is wedged between the outer race of the sheave and the inclined surface of the clutch body. When the sheave is rotated in the opposite direction, the cylindrical body will be urged by its contact with the outer race of the sheave, out of wedging contact. This also occurs when the driven shaft rotates in the driven direction at a surface speed which is greater that the surface speed of the outer race of the sheave. This permits the drive shaft of the knitting machine to over-run the drive sheave and prevents the knitting machine from being driven in the reverse direction The one-way clutch utilized in the invention is self centering in that three or more points of contact between the outer race of the sheave and the cylindrical roller members disposed within the peripheral recesses of the clutch body. The clutching rollers engage smoothly regardless of wear.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

Figure 1:
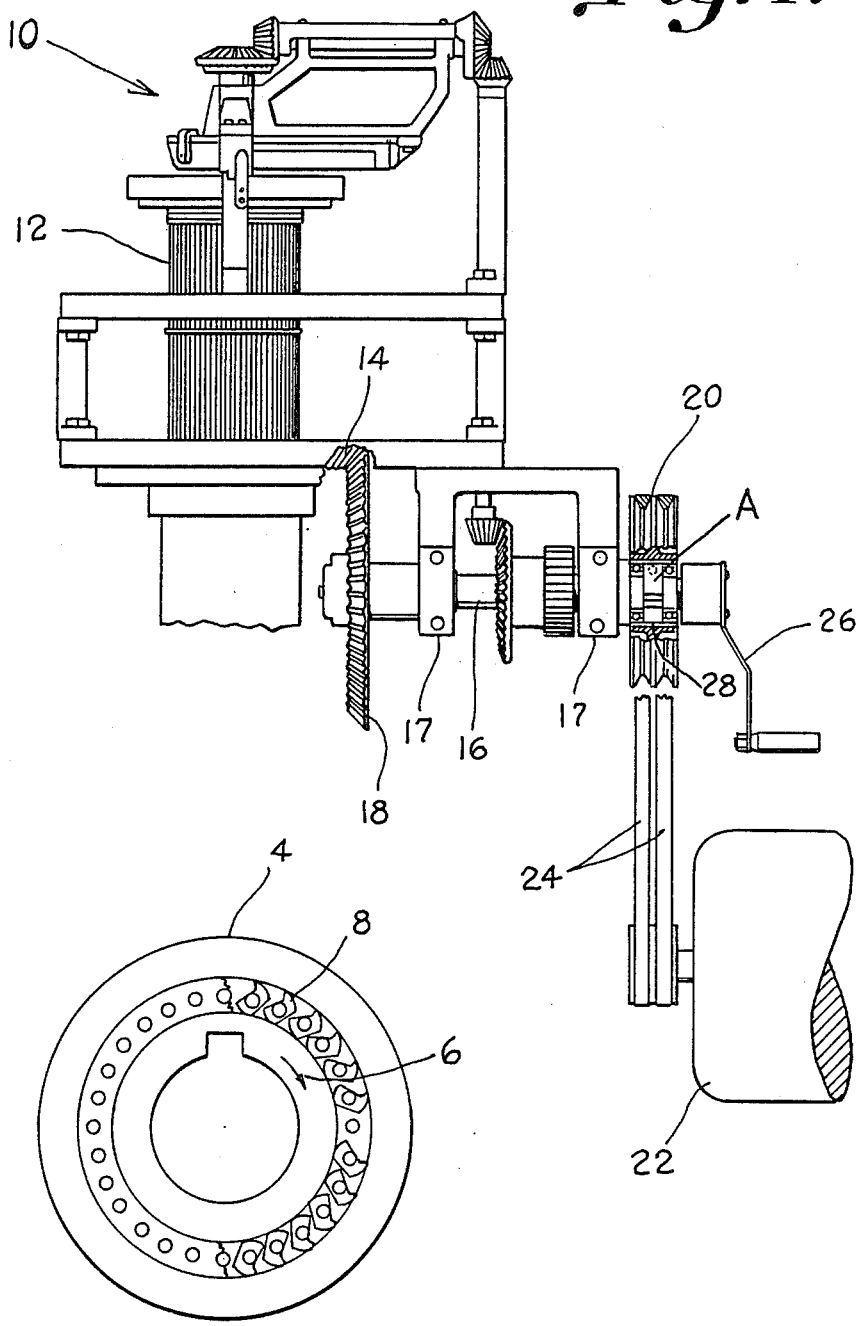
Figure 2:
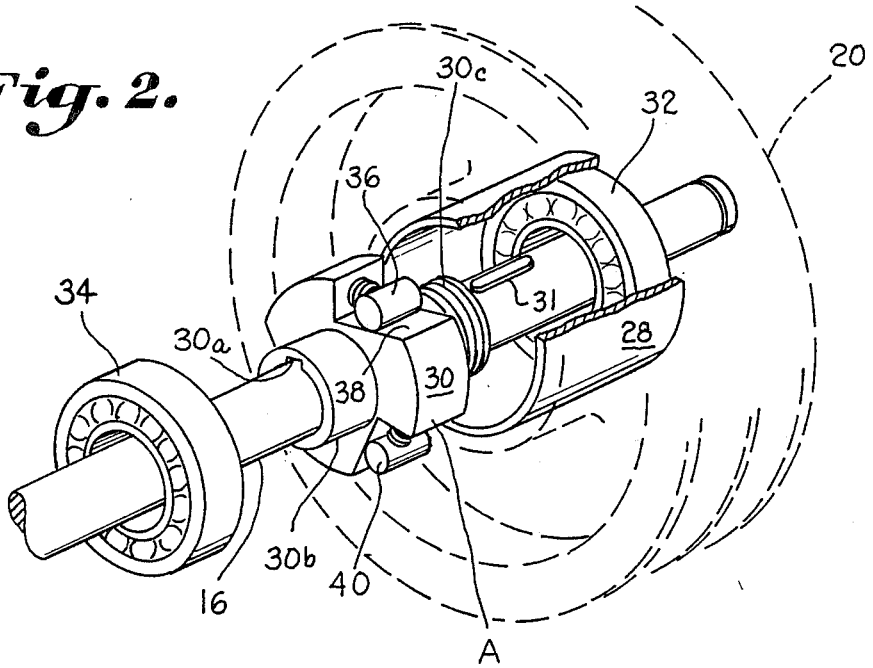
Figure 3:
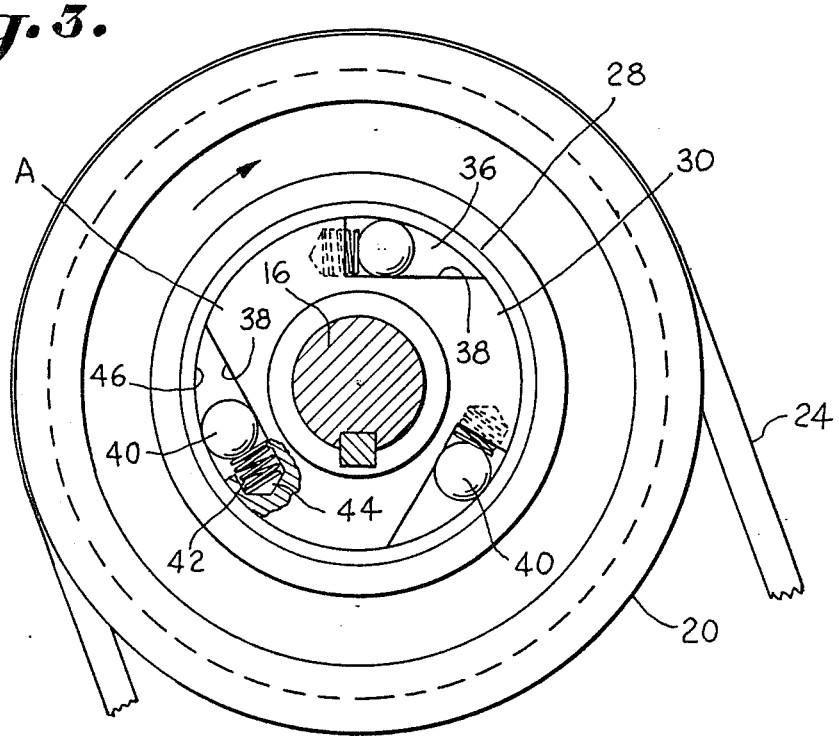

The Prior Art Shown in FIG. 4 illustrates a one-way sprag clutch conventionally used in circular hose knitting machines;

FIG. 1 illustrates a portion of a circular knitting machine which includes a driving arrangement constructed in accordance with the teachings of the present invention;

FIG. 2 is an exploded perspective view of the one-way clutch of the present drive, showing the sheaves in phantom; and FIG. 3 is an enlarged side view of the sheave and one-way clutch drive of the invention, with one of the bearings for supporting the sheave on the main drive shaft omitted.

DESCRIPTION OF A PREFERRED EMBODIMENT

Referring first to FIG. 4 wherein, there is shown a typical sprag one-way clutch utilized in the "Billi Ultra 4-S circular hose knitting machine. This clutch comprises an inner race 6 which is keyed to the main drive shaft of the knitting machine and an outer race 4 which is rigidly connected to the drive sheave to receive a drive from a suitably driven drive belt.

Interposed in the space between the inner race 6 and outer race 4 is a plurality of pivoting sprags 8. These sprags are pivoted so that when the outer race 4 moves in one direction (that shown by the arrow on the outer race) it will normally transmit its driving force through the pivoted sprags to the inner race 6, and, therethrough, to the main drive shaft of the knitting machine. Sprags 8 are shaped in size so that normally they will be unable to pivot more than a limited amount in the direction of the arrow on the outer race 4. However, as noted above in the background portion of this application, the surfaces and shapes of the sprags become worn very quickly during use and will no longer perform in the manner intended. A more detailed analysis of the problems of the sprag one-way clutches is set forth in the 1983–1984 issue of "POWER TRANSMISSION DESIGN HANDBOOK" pages C-105 and C-106, in an article written by James P. Rusnack of the Dana Corporation of Warner, Mich. This publication is published by Penton/IPC, subsidiary of Pitway Corporation, 1111 Chester Avenue, Cleveland, Ohio 44114 and copyrighted in 1983. This article explains in detail the functioning of so called sprag clutches and explains also many of the problems of using such clutches.

Referring now to FIGS. 1, 2, and 3 of the drawings. In FIG. 1, there is shown a circular knitting machine 10 which has a needle cylinder 12 which is mounted for rotation about its longitudinal axis. During the normal operation of circular knitting machine 10, to produce panty hose, yarns of different sizes are guided into the hooks of the needles within cylinder 12, as needle cylinder 12 revolves about its longitudinal axis. Needle cylinder 12 carries either three hundred and forty or four hundred and two needles, within a like number of slots on the surface of needle cylinder 12. As the needle cylinder 12 revolves, the needles are raised and lowered by suitable cams (not shown) to receive yarn in the hooks of the knitting needles and to form knitted loops therefrom over suitable sinkers. The operation of the sinkers, the yarn guides and the knitting needles and the appropriate cams have not been shown herein as they are not, per se, a part of the instant invention. However, it should be noted that such instrumentalities are very small and must move in very precise paths and at precise times and therefore require that the knitting machine be precisely driven.

Needle cylinder 12 is driven by a needle cylinder beveled gear 14 which is affixed to the needle cylinder and rotates therewith. The main drive shaft 16 is supported in suitable bearings 17 on the frame of the knitting machine 10 Rigidly connected to main drive shaft 16 by a suitable key or the like is a drive beveled gear 18 which meshes with the needle cylinder beveled gear 14 so that rotation of main drive shaft 16 be imparts rotational movement to the needle cylinder 12.

Adjacent the end of the main drive shaft 16, opposite from where drive beveled gear 18 is affixed, is a double drive sheave 20 which is supported on main drive shaft 16 for rotation thereabout by bearings 32 and 34, respectively. As will be discussed in more detail hereinafter, drive sheave 20 will rotate shaft 16 whenever it is revolved in one direction and will not rotate main drive shaft 16 whenever it is revolved in the opposite direction. Drive sheave 20 is driven by means of drive belt 24 from a suitable drive motor or power source 22. A manual drive crank 26 is affixed to the end of main drive shaft 16 by means of a one-way clutch which will permit the operator of the circular knitting machine to turn the cylinder about its longitudinal axis, by hand, whenever setting the machine up or when it is necessary to make repairs to the knitted fabric in the event of a broken yarn or the like. As will be noted hereinafter in more detail, a one-way clutch is contained within drive sheave 20 to permit main drive shaft 16 to be driven in the forward direction whenever sheave 20 is at rest. Whenever the knitting machine is being stopped, it permits the needle cylinder to coast to a stop rather than stopping abruptly which might damage the gears or the knitting instrumentalities.

Referring now more particularly to FIGS. 2 and 3 wherein details of the one-way clutch and sheave 20 is shown in enlarged views. Disposed within hub 21 of drive sheave 20 is a cylindrical sleeve 28 which is rigidly connected to the drive sheave and the outer races of bearings 32 and 34 to support sheave 20 for rotation about drive shaft 16. The inner diameter of sleeve 28 also functions as the outer race of the one-way clutch mechanism. Disposed inside of sleeve 28 is a one-piece clutch assembly A having a clutch body 30 with an outer diameter which is only slightly less than the inner diameter of sleeve 28. Clutch body 30 is ridigly connected to main drive shaft 16 by a suitable key way **30*a* formed in hollow shaft 30*b* which fits onto a key 31 affixed to drive shaft 16 and has extensions, extending past each side of the clutch body 30. Clutch body 30 is normally enclosed within sleeve 28 by bearings 32 and 34 extending about the extensions of hollow shaft 33. Clutch body 30 and hollow shaft 30*b* are one-piece. Threads 30*c* on one extension of the hollow shaft 30*b* provide means for pulling the clutch off of the drive shaft. The threaded portion 30*c* extends beyond bearing 32 and a tool may be threaded thereon for the removal of the clutch body 30 from within sleeve 28**.

Clutch body 30 has a plurality of L-shaped recesses 36, each of which has an inclined surface 38 inclining towards the periphery of clutch body 30. Disposed within each of the L-shaped recesses 36 is a cylinder or roll 40 which is not longer than the thickness of the clutch body and whose diameter is slightly greater than the depth of recess 36 at its deepest end. That is, its diameter is slightly greater than the length of the short wall of the L-shaped recess 36. Disposed within a bore 44 is a roll spring 42 which urges roll 40 away from the short leg of the L-shaped recess into wedging contact with inclined surface 38 and inner surface 46 of sleeve 28, which forms the outer race of the sheave. Whenever sheave 20 is driven in the direction of the arrow shown on the sheave in FIG. 3, it tends to wedge roller 40 between the inclined surface 38 and the outer race 46 to provide a positive drive connection between sheave 20 and main drive shaft 16. At the same time, whenever sheave 20 is held stationary, shaft 16 can be rotated in the same direction as the arrow on the sheave, without moving or disturbing sheave 20. This might take place whenever the machine is stopping to permit the machine to coast to a stop rather than to come to an abrupt stop or whenever the machine is being driven manually, as by crank 26.

As will be seen in FIG. 3, there is a plurality of L-shaped recesses 36, evenly spaced about the periphery of the clutch body 30. It will be appreciated that more than three recesses could be utilized if desired so long as they are evenly spaced about the periphery of the clutch body. It will also be noted that each roll or cylinder 40 is urged into wedging contact with the inclined surface 38 and the outer race 46. This will be true regardless of the wear which may have taken place on the surfaces of roller 40 or the surface of the inner race 46. This wedging action prevents slippage and roll-over and grabbing of the drive, which, as noted above, resulted in broken shafts and broken gears.

Further, in accordance with the present invention, clutch body 30 is formed of E52100 high bearing steel which is hardened to 62/63 on the R.C. scale. It has been found that by utilizing high bearing steel hardened to this degree for the clutch body and the inner race 46, rolls or cylinders 40 wear uniformly in a circular manner. This results in much longer life of the one-way clutch of the invention.

In accordance with the invention, apparatus and method are disclosed for converting a drive of a "Billi Ultra 4-S and the like circular hose knitting machines for improved clutch operation and reduced gear breakage. The conventional inner race and S-formed sprage clutch are replaced with a one-piece clutch unit A having roll formed sprags which is affixed directly onto drive shaft 16 and inside of input drive sheave 20. The one-piece clutch unit includes a threaded end so that the one-piece unit may be pulled directly off of the drive shaft. Roll formed sprags of the clutch reduce and compensate for wear. The one-piece clutch unit is self-centering in that there are three points of contact which are equidistant to the center of the unit and exert equal pressure on the locking points against the outer race. In this manner, uneven wear is reduced. By hardening of the body of the drive clutch to 62/63 on the RC scale and constructing the body unit of E52100 high bearing steel, the one-piece unit drives the knitting machine drive shaft and output gears in a manner that indentions formed by peening of rollers 40 are minimized in the surface 38 of the clutch unit which would otherwise cause problems. By having the surface hardened, the roller will wear evenly and move further out in order to lock the unit in the drive mode. If the drive unit were made out of softer steel, the roller would tend to peen and form an indenture which would get deeper and deeper to the point that the roller would no longer engage in the drive mode.

While a preferred embodiment of the invention has been described using specific terms, such description is for illustrative purposes only, and it is to be understood that changes and variations may be made without departing from the spirit or scope of the following claims.

What is claimed is:

1. Apparatus for converting the drive of a circular hose knitting machine to reduce wear and gear breakage, said circular hose knitting machine being of the type having a needle cylinder carrying a plurality of knitting needles, a beveled cylinder gear connected to said needle cylinder, a beveled cylinder drive gear affixed to a drive shaft meshing with said beveled gear of said knitting cylinder for revolving said knitting cylinder to effect a knitting motion of said knitting needles; an input drive sheave coupled to said drive shaft; and a clutch assembly coupling said input drive sheave and said drive shaft which includes an inner bearing race affixed to said drive shaft, an outer bearing race affixed to said input drive sheave, and an S-sprag clutch carried between said inner and outer races having a plurality of S-formed sprags which engage said inner and outer races to effect a drive engaging connection between said input drive sheave and said drive shaft when said input sheave is driven in rotation while permitting free rotation of said drive shaft when said input drive shaft is not driven in rotation wherein said apparatus comprises:

(a) a clutch unit directly affixed to said drive shaft adapted for replacing said inner bearing race and said S-sprag clutch, said clutch unit having a clutch body with a plurality of evenly spaced recesses formed in the outer periphery of said clutch body and each of said recesses having one flat surface inclined towards said periphery and said clutch unit having an extension on each side of said clutch body;

(b) said outer bearing race connected to the inner surface of said hollow sheave and having a smooth, even surface surrounding said clutch body;

(c) a plurality of locking members, one disposed in each of said recesses;

(d) biasing means for independently urging each of said locking members outwardly of its recess in a manner that said locking members move outwardly into wedging contact between the inclined flat surface of said recess and the outer race so that when said sheave is rotated in one direction said members will be wedged more tightly into driving contact with the outer race and the inclined flat surface and out of wedging contact with the outer race when said sheave is rotated in the opposite direction;

(e) bearings supported by each of the extensions of said clutch body and engaging said outer bearing race for supporting said input sleeve for rotation relative to said clutch unit; and (f) means disposed on one of said extensions for facilitating the removal of said clutch unit from said drive shaft.

2. A circular knitting machine as set forth in claim 1, wherein said clutch body has three recesses in its outer periphery.

3. A circular knitting machine as set forth in claim 1, wherein said clutch body is connected to said main drive shaft by means of a key.

4. A circular knitting machine as set forth in claim 1, wherein said spring means is a coil spring partially retained in a bore in said clutch body.

5. A knitting machine as set forth in claim 1, wherein said clutch unit extension include a hollow shaft which fits over and is affixed against rotation to said drive shaft.

6. The apparatus as set forth in claim 5, wherein said means for facilitating removal includes one of said extensions provided with threads for facilitating removal of the clutch unit from said drive shaft.

7. In a knitting machine as set forth in claim 1, wherein said clutch body is formed from high bearing steel and is hardened to 62/63 on the RC scale to reduce peening of said recess wall by said locking roll during clutching.

8. In a circular knitting machine having a needle cylinder, carrying a plurality of knitting needles, a beveled gear connected to said needle cylinder and meshing with a beveled gear keyed to a drive shaft for revolving said needle cylinder, means to revolve said drive shaft in only one direction, comprising:

(a) a driven, hollow sheave supported for rotation about the drive shaft;

(b) a clutch body rigidly connected to said drive shaft, having a plurality of evenly spaced recesses in the outer periphery of said clutch body, each of said recesses having a flat surface inclined towards said outer periphery of said clutch body and said clutch body having an extension on each side thereof;

(c) a smooth outer race rigidly connected to the inner surface of said hollow sheave which surrounds the outer periphery of said clutch body;

(d) a plurality of locking members, one in each of said recesses;

(e) bearings supported by each of said clutch body extensions and engaging said outer bearing race for supporting said input sheave for rotation relative to said clutch body and said drive shaft;

(f) means disposed on one of said extensions for facilitating the removal of said clutch body from said drive shaft; and (g) biasing means for independently urging each of said locking members into wedging contact between the flat surface of said recess and the outer race of said hollow sheave so that when said sheave is rotated in one direction, said members will be wedged more tightly into driving contact with the outer race and the inclined, flat surface and out of wedging contact with the outer race when said sheave is rotated in the oppoosite direction.

9. In a circular knitting machine as set forth in claim 8, wherein said clutch body has three recesses in its outer periphery.

10. In a circular knitting machine as set forth in claim 8, wherein said clutch body is rigidly connected to said main drive shaft by means of a key.

11. In a circular knitting machine as set forth in claim 8, wherein said spring means is a coil spring partially retained in said clutch body.

12. In a knitting machine as set forth in claim 8, wherein said clutch body is formed from high bearing steel and is hardened to 62/63 on the RC scale to reduce peening of said recess wall by said locking roll during clutching.

13. In a knitting machine as set forth in claim 12, wherein said means for facilitating the removal of the clutch body from the drive shaft comprises threads on said one of said extensions.

14. A method of reducing gear breakage in the drive train of a circular hose knitting machine of the type having a needle cylinder carrying a plurality of knitting needles, a beveled gear connected to said needle cylinder, a beveled drive gear affixed to a drive shaft meshing with said beveled gear of said knitting cylinder for revolving said knitting cylinder to effect a knitting motion of said knitting needles; an input drive sheave coupled to said drive shaft; and a clutch assembly coupling said input drive sheave and said drive shaft which includes an inner bearing race affixed to said drive shaft, an outer smooth bearing race affixed to said input drive sheave, and an S-sprag clutch carried between said inner and outer races having a plurality of S-formed sprags which engage said inner and outer races to effect a drive engaging connection between said input drive sheave and said drive shaft when said input sheave is driven in rotation while permitting free rotation of said drive shaft when said input drive shaft is not driven in rotation wherein the method comprises:

(a) removing said inner race from said drive shaft;

(b) removing said S-sprag clutch from said drive shaft;

(c) providing a unitary clutch unit having a hollow shaft adapted to be slidably received over and affixed to said drive shaft; and (d) providing said clutch unit in the form of a clutch body, one-piece with said hollow shaft and having an extension of said hollow shaft extend beyond the clutch body on each side of said body, said clutch body having a plurality of equidistantly spaced recesses in the outer periphery of said clutch body and each of said recesses having one flat surface inclined toward said periphery; an outer race connected to the inner surface of the hollow sheave and surrounding said clutch body; a plurality of locking members one disposed in each of said recesses; and biasing means for independently urging each of said locking members outwardly of its recess, into wedging contact between the inclined flat surface of said recess and said outer race so that when said sheave is rotated in one direction said members will be wedged more tightly into driving contact with the outer race and the inclined flat surface in a manner such that wear is automatically taken into account and said locked-in members are permitted to move out of wedging contact with said outer race when said sheave is rotated in the opposite direction; bearing means supported by said extensions of said hollow shaft on each side of said clutch body, said bearings supporting said outer race for relative movement about said hollow shaft extension and means provided on one of said hollow shaft extensions for facilitating the removal of said clutch body from said drive shaft.

15. The method of claim 14 including providing said clutch body formed from high bearing steel with said recess surfaces hardened to 62/63 on the RC scale in a manner that peening of said locking member into said recess surfaces is effectively reduced to prevent clutch failure.

16. The method of claim 14 wherein said means for facilitating said removal includes one of said hollow shaft extensions provided with threads for facilitating removal of said clutch unit from said drive shaft.

* * * * *